US005277603A

United States Patent [19]

Yamatani et al.

[11] Patent Number: 5,277,603

[45] Date of Patent: Jan. 11, 1994

[54] ELECTRIC CONNECTOR

[75] Inventors: Eiji Yamatani, Omiya; Takahiro Yoneda, Kanagawa, both of Japan

[73] Assignees: Kansei Corporation, Omiya; Nissan Motor Co., Ltd., Yokohama, both of Japan

[21] Appl. No.: 972,772

[22] Filed: Nov. 9, 1992

[30] Foreign Application Priority Data

Nov. 11, 1991 [JP] Japan ..... 3-294306
Apr. 22, 1992 [JP] Japan ..... 4-102744

[51] Int. Cl.[5] ..... H01R 13/44

[52] U.S. Cl. ..... 439/140; 439/137; 439/367; 439/893

[58] Field of Search ..... 439/137; 140, 367, 893

[56] References Cited

U.S. PATENT DOCUMENTS 4,791,608 12/1988 Fushimoto ..... 439/140
4,955,817 9/1990 Sugai ..... 439/137
5,037,319 8/1991 Hatagishi ..... 439/140
5,051,100 9/1991 Kato et al. ..... 439/140
5,090,117 2/1992 Dickie ..... 439/140

*Primary Examiner*—Paula A. Bradley
*Attorney, Agent, or Firm*—Keck, Mahin & Cate

[57] ABSTRACT

An electric connector provided with a protective cover for protecting terminals fixed in a male connector housing. Locking components formed on the protective cover and the housing are interlocked with each other so as to make the protective cover stable except when the male housing is fitted in a corresponding part. By inserting the male connector housing into the corresponding part, the locking components are automatically released from the interlock, the protective cover is slid by the wall of the corresponding part, and the terminals are connected with circuit patterns of a printed wiring board mounted on the wall of the corresponding part. The electric connector permits the protective cover to securely protect the terminals against a collision with other male housings when they are conveyed, for example.

5 Claims, 9 Drawing Sheets

ELECTRIC CONNECTOR

BACKGROUND OF THE INVENTION (1) Field of the Invention

This invention relates to an electric connector provided with a protective cover for protecting terminals disposed in a connector housing except when the connector is fitted in a corresponding part.

(2) Description of the Prior Art

A conventional electric connector in the field is described in Japanese Utility Model Application Early Laid-open Publication No. Sho 57-10470, for example. This is constructed as shown in FIGS. 1 to 4. A connector housing or male connector housing 1 includes hollows 2 in each of which a terminal 4 united with a conducting wire 3 is fixed. At the side of the male connector housing 1 is formed a window 5 through which the terminals 4 are viewed.

To protect the terminals 4 from any damage when the housing 1 is conveyed to some place, for example, a protective cover 6 is fitted in the window 5 slidably up and down in FIG. 1. On the other hand, a corresponding connector housing or female connector housing 7 includes a hole 8 for receiving the male connector housing 1. In the hole 8 is extended a tongue portion 10 of a flexible printed wiring board 9 disposed on the wall of the female connector housing 7.

As shown in FIG. 3, when the male connector housing 1 is inserted into the fitting hole 8 of the female connector housing 7, the lower edge of the protective cover 6 comes in contact with the wall of the female connector housing 7, or, to say more precisely, the flexible printed wiring board 9. At the same time, the protective cover 6 is slid upward, the window 5 is opened, and the terminals 4 are each connected with circuit patterns 11 of the printed wiring board 9.

However, in the conventional electric connector, the side edges of the protective cover 6 are unfixedly fitted in grooves 1*a* formed in the male connector housing 1 as shown in FIG. 4. Therefore, the protective cover 6 is easily slid up or the window 5 is carelessly opened by turning the male connector housing 1 upside down, so that the terminals 4 are damaged or deformed.

That is to say, a drawback is that there is often opened the window 5 for completely protecting the terminals 4 disposed in the male connector housing 1 when the male connector housing 1 is conveyed or installed.

Further, a guide frame 1*b* must be fixed to the male connector housing 1 in order to form the grooves 1*a* at the both sides of the housing 1. The fixation of the guide frame 1*b*, however, results in the enlargement of the housing 1. Accordingly, the female connector housing 7 also is enlarged because the hole 8 must be arranged to fit the enlarged male connector housing 1. Such a large sized connector housing, however, is inconvenient for an electric connector used in a small space, such as an automobile.

Further, as shown in an arrow of FIG. 4, the application of external force to the protective cover 6 causes a bend of the cover from the position of a phantom line to the position of a solid line, so that some terminals 4 are damaged.

SUMMARY OF THE INVENTION

It is therefore an object of the invention to provide an electric connector in which a protective cover for protecting terminals disposed in a connector housing is not carelessly opened when conveyed, for example, and the fixation of the protective cover is automatically released by inserting the housing into a corresponding part and the terminals are certainly connected with circuit patterns provided in the corresponding housing when the housing is fitted in the other.

It is another object of the invention to provide an electric connector with a small sized housing.

It is still another object of the invention to provide an electric connector capable of protecting the terminals against the application of external force to the protective cover.

To accomplish the objects, an electric connector provided with a slidable protective cover for opening and closing a window through which terminals disposed in a connector housing are viewed according to the invention is characterized by a locking arm formed in the housing, locking means for permitting the protective cover to keep the window closed, the locking means being formed at a place where the locking arm and the protective cover are engaged with each other, means for bending the locking arm when the connector housing is inserted into the other corresponding housing, and the interlock of the locking means with each other being released by a bend of the locking arm to open the window.

Further, an electric connector with a slidable protective cover for opening and closing a window through which terminals disposed in a connector housing are viewed according to the invention is characterized by the protective cover being made so ring-like as to surround the connector housing.

Further, an electric connector with a slidable protective cover for opening and closing a window through which terminals disposed in a connector housing are viewed according to the invention is characterized by ridges formed on the reverse side of the protective cover, the ridges being in contact with the surface of the corresponding connector housing between the terminals.

According to the invention, the protective cover arranged slidablely in the male connector housing is locked to keep the cover stable by the interlock of the locking means with each other while the window is closed by the cover. Therefore, the protective cover can securely guard the terminals against damage, such as a collision with the other male connector housings, without releasing its interlock when the male connector housings are conveyed, for example. When the connector housing or male connector housing is inserted into the corresponding connector housing or female connector housing, the bending means formed on the locking arm are pressed by the wall of the female connector housing, the bend of the locking arm leads to a release of the interlock of the locking means, the lower edge of the protective cover is raised upward, and the terminals can be certainly connected with the circuit patterns disposed on the wall of the female connector housing.

Further, according to the invention, since the protective cover is made ring-like and hence the guide frame of the conventional electric connector is not required, the male connector housing can be made smaller in size than the conventional one and further a single protective cover can protect the terminals disposed at the both sides of the housing.

Further, according to the invention, a plural number of ridges are formed on the reverse side of the protective cover. The end surface of the ridge is in contact with the sliding surface of the male connector housing between the terminals, so that the terminals are securely protected by the cover without a bend of the protective cover caused by external force.

DETAILED DESCRIPTION OF THE EMBODIMENT

Figure 1:
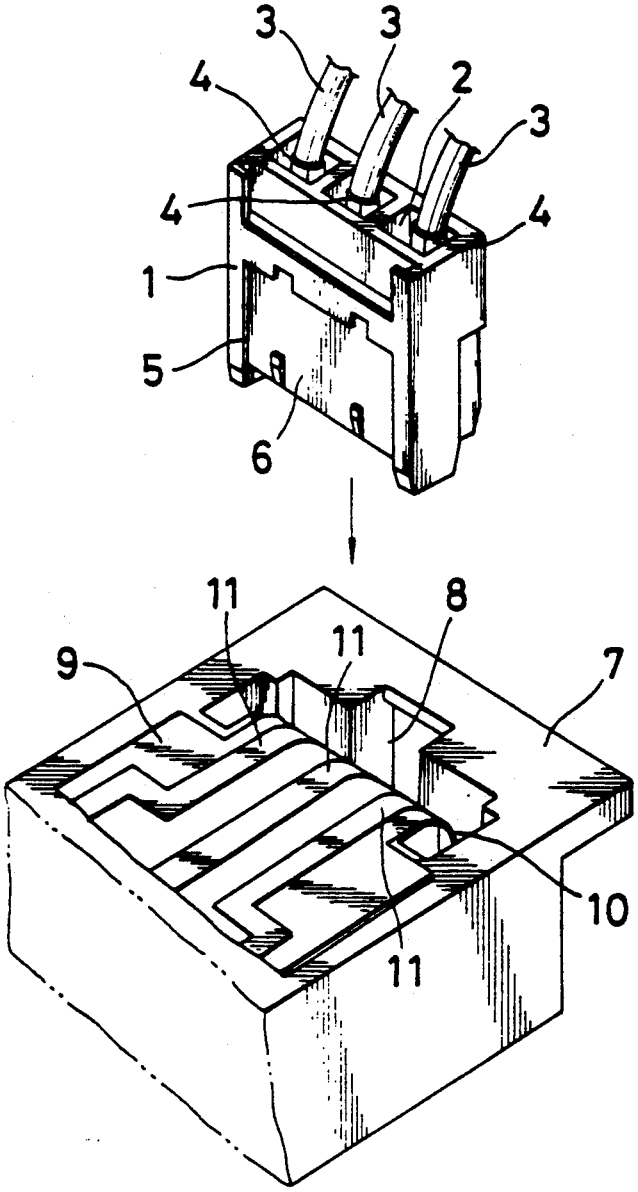
FIG. 1 (PRIOR ART)
FIG. 1 is a perspective view showing the construction of a conventional electric connector.
Figure 2:
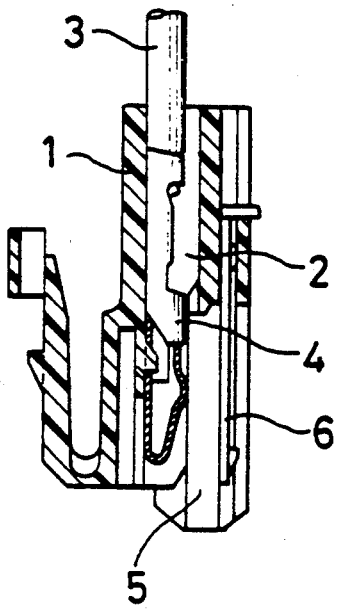
FIG. 2 (PRIOR ART)
FIG. 2 is a sectional side view of the conventional electric connector.
Figure 3:
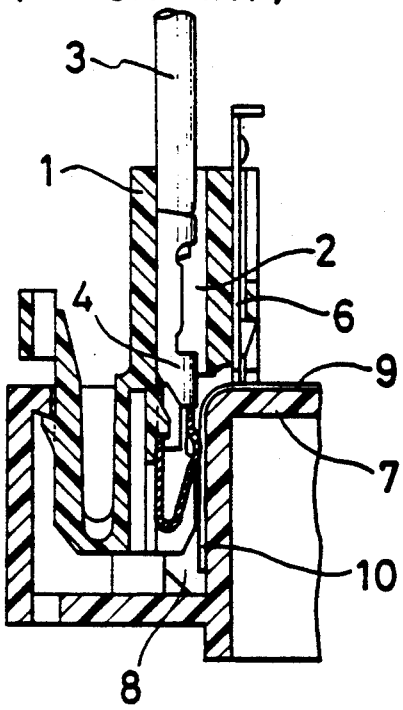
FIG. 3 (PRIOR ART)
FIG. 3 is a sectional side view of the conventional electric connector inserted into a corresponding housing.
Figure 4:
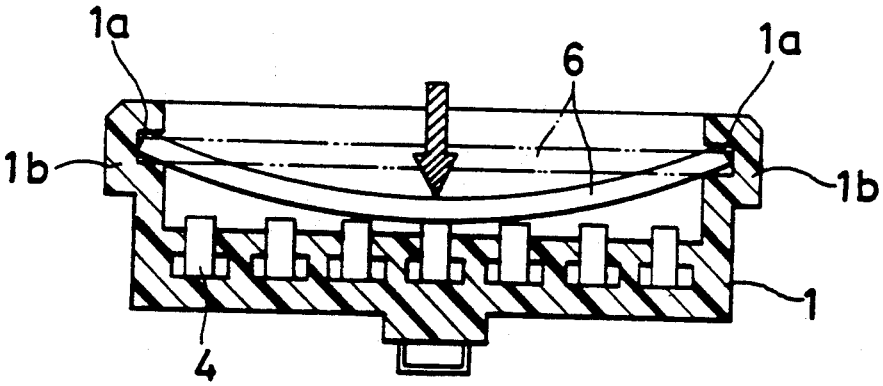
FIG. 4 (PRIOR ART)
FIG. 4 is a transverse sectional view of the conventional electric connector.

The invention will be hereinafter described in detail with reference to the drawings.

Referring now to FIGS. 5 to 9, the reference numeral 21 designates a connector housing or male connector housing. In the housing 21 are made hollows 22 in each of which a terminal 24 united with an electric wire 23 is fixed. At the side of the housing 21 is formed a window 25 through which the terminals are viewed. At the frame of the window 25 are made guide grooves 26 for sliding a protective cover 27 in order to open and shut the window 25. The protective cover 27 serves to protect the terminals 24 by shutting the window 25 when the male connector housing 21 is conveyed, for example. Through the protective cover 27 is bored a hole 28 for permitting the cover 27 to keep the window 25 closed. With the hole 28 is interlocked a locking claw 30 projected from a locking arm 29 integrated with the male connector housing 21. A wedge-shaped projection 35 is also formed at the end of the locking arm 29. A convex portion 37 of the protective cover 27 is fitted in a concave portion 36 between the locking claw 30 and the wedge-shaped projection 35, so that the protective cover 27 is locked unmovablely in the directions of arrows B and C shown in FIG. 5.

Figure 9:
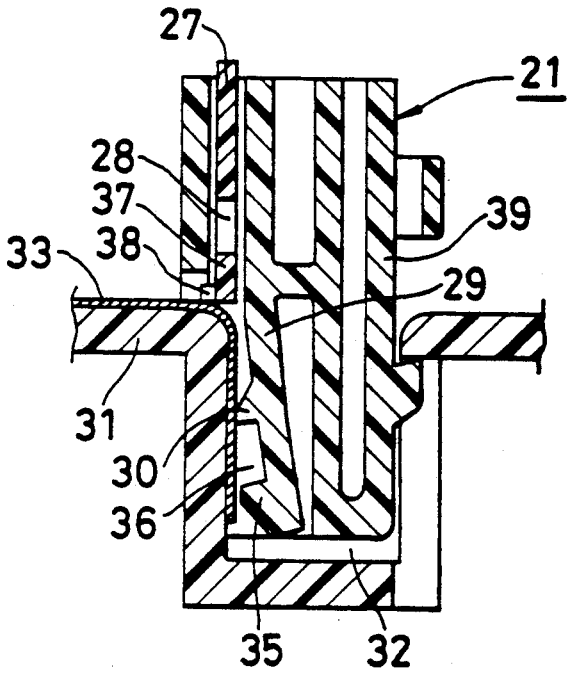
FIG. 9 is a side sectional view of the electric connector according to the first embodiment of the invention, showing the electric connector completely fitted in the corresponding part.
Figure 10:
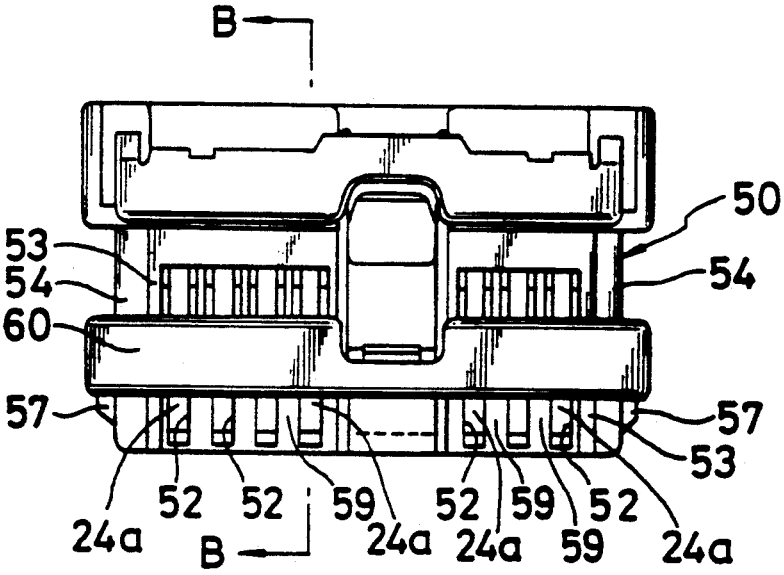
FIG. 10 is a front view of an electric connector according to a second embodiment of the invention.

A stopper 38 formed on the protective cover 27 serves to protect the cover 27 against coming off the male connector housing 21 when the convex portion 37 is not fitted in the concave portion 36, that is, when the convex portion 37 is positioned at any place between the locking claw 30 and the fulcrum side of the locking arm 29 (or at the opposite side from the projection 35 with respect to the locking claw 30) as shown in FIG. 9.

The reference numeral 31 designates a corresponding connector housing or female connector housing including a fitting hole 32 for receiving the male connector housing 21. On the wall of the female connector housing 31 is disposed a flexible printed wiring board 33 on which circuit patterns are provided. A tongue portion 34 of the printed wiring board 33 is extended into the fitting hole 32 of the female connector housing 31. The housing 31 and the tongue portion 34 make up a female connector capable of contacting the male connector housing.

There will be now described the operation of the electric connector according to the embodiment of the invention.

Figure 5:
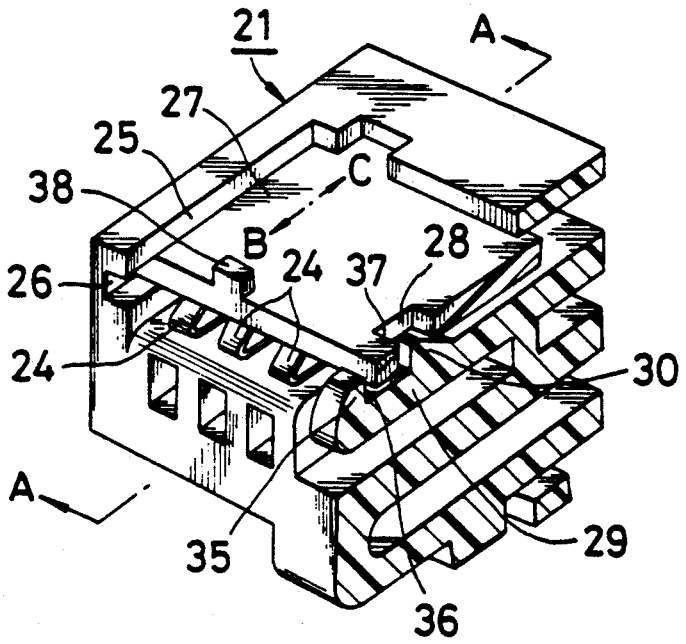
FIG. 5 is a perspective view of a half-cut electric connector according to a first embodiment of the invention.
Figure 6:
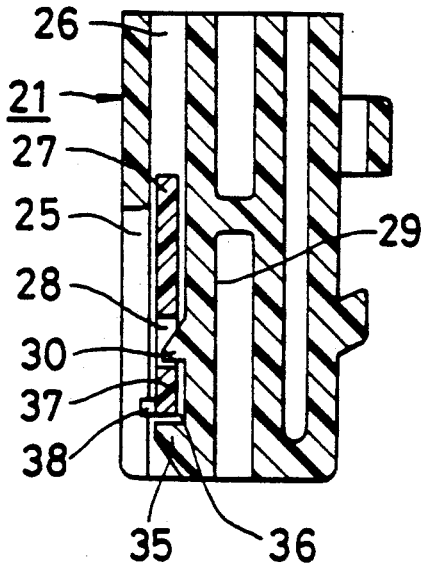
FIG. 6 is a sectional side view of FIG. 5.
Figure 7:
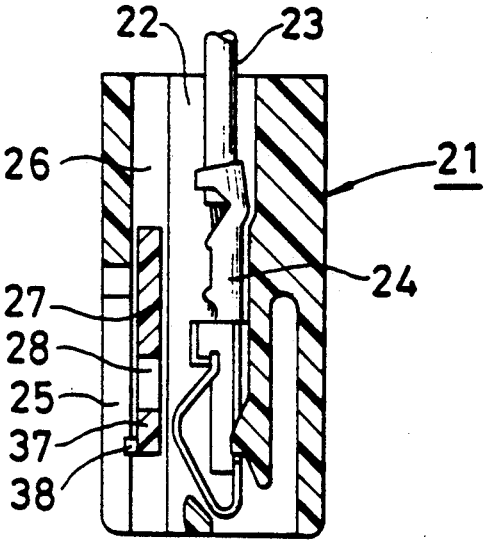
FIG. 7 is a sectional view taken along the line A—A of FIG.

As shown in FIGS. 5 and 6, the protective cover 27 fitted in the male connector housing 21 protects the terminals 24 disposed in the housing 21 by usually closing the window 25 so as not to bare them. When the convex portion 37 of the cover 27 is fitted in the concave portion 36 between the locking claw 30 and the projection 35, the protective cover 27 keeps the window 25 closed without moving in the directions of arrows B and C of FIG. 5. The reference numeral 39 in FIGS. 8 and 9 designates a fastening component for fastening the male connector housing 21 to the female connector housing 31.

Figure 8:
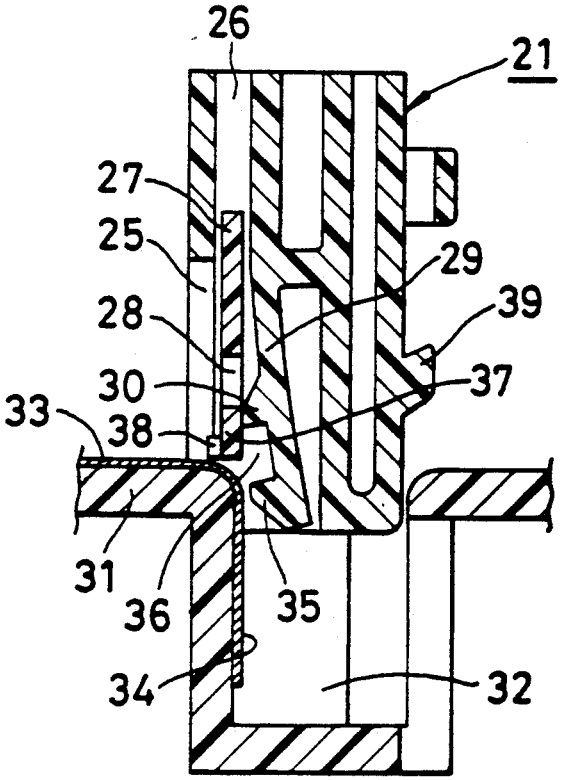
FIG. 8 is a side sectional view of the electric connector according to the first embodiment of the invention, showing the electric connector immediately after insertion into a corresponding part.

As shown in FIG. 8, when the male connector housing 21 is inserted into the fitting hole 32, the projection 35 of the arm 29 is pressed by the wall of the female connector housing 31 and hence the arm 29 is bent. A bend of the arm 29 brings on each separation of the convex portion 37 from the concave portion 36, the locking claw 30 from the locking hole 28, and the convex portion 37 from the tip of the locking claw 30. As shown in FIG. 9, when the male connector housing 21 is inserted still deeper in the hole 32, the lower edge of the protective cover 27 comes in contact with the wall of the female connector housing 31 or, to say more precisely, the surface of the flexible printed wiring board 33 and then the cover 27 is pushed up to open the window 25. At the same time, the terminals 24 disposed in the hollows 22 are each connected with the circuit patterns mounted on the tongue portion 34 of the printed wiring board 33.

In the first embodiment of the invention, the protective cover 27 arranged slidablely in the male connector housing 21 is locked to keep it stable by each engagement of the locking claw 30 with the hole 28 and the projection 35 with the convex portion 37 while the window 25 is closed by the cover 27. Therefore, the cover 27 can securely guard the terminals 24 against damage, such as a collision with other male connector housings 21, without releasing its engagement when they are conveyed, for example. Further, by inserting the male connector housing 21 into the female connector housing 31, the interlock of the locking components 28, 30, 35, and 37 is released, the protective cover 27 is pushed up, the window 25 is opened, the male connector housing 21 is fitted in the fitting hole 32, and the terminals 24 can be automatically and certainly connected with the circuit patterns 34.

FIGS. 10 to 15 show a second embodiment of the invention.

Figure 11:
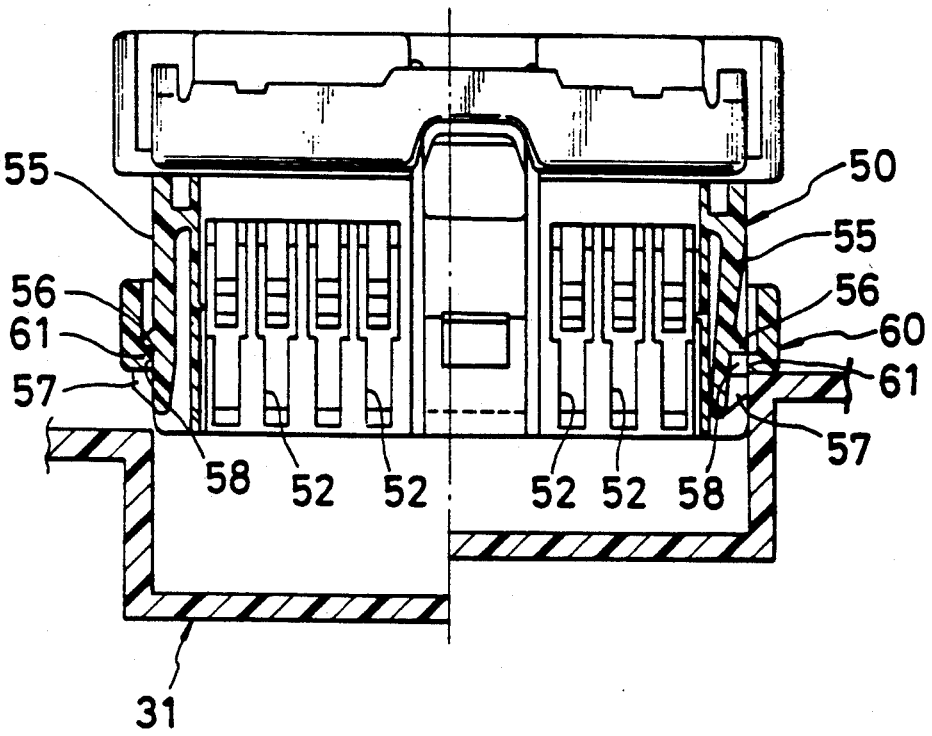
FIG. 11 is a front sectional view of the electric connector according to the second embodiment of the invention.
Figure 12:
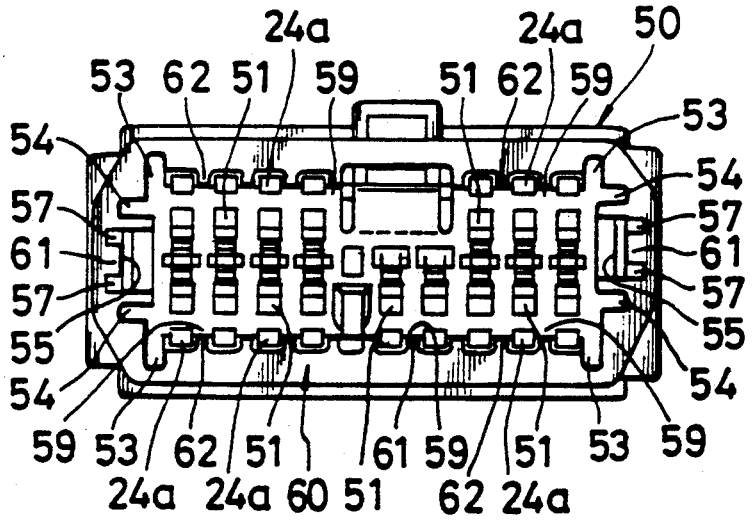
FIG. 12 is a bottom view of FIG. 10.
Figure 13:
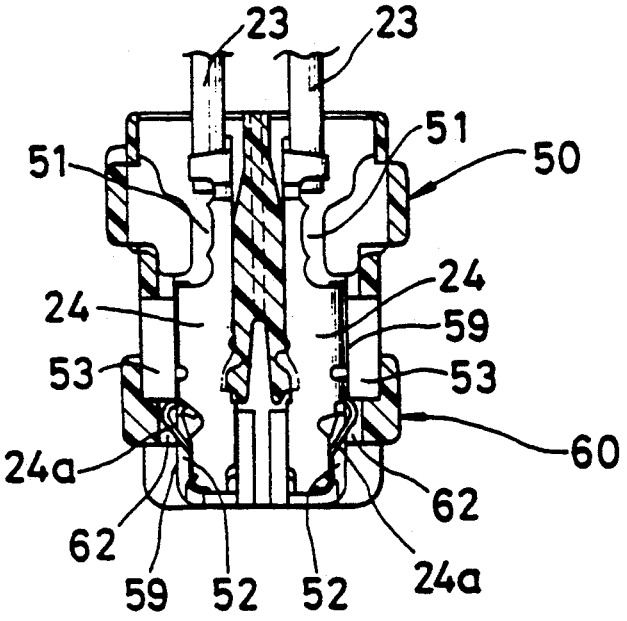
FIG. 13 is a sectional view taken along the line B—B of FIG. 10.
Figure 14:
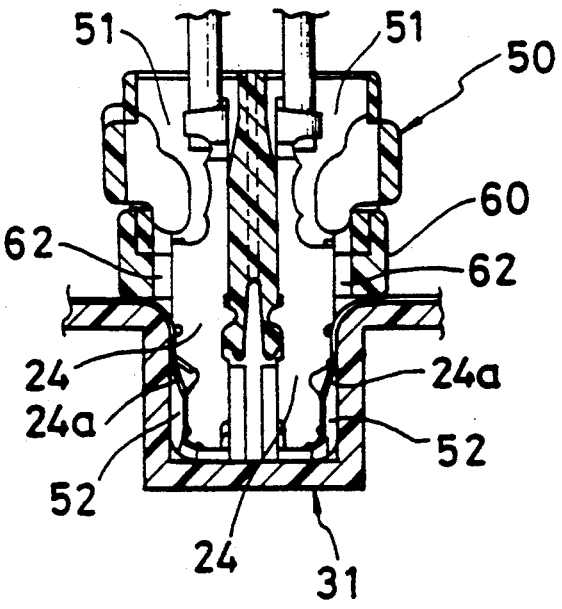
FIG. 14 is a sectional view of the electric connector inserted into a corresponding part.
Figure 15:
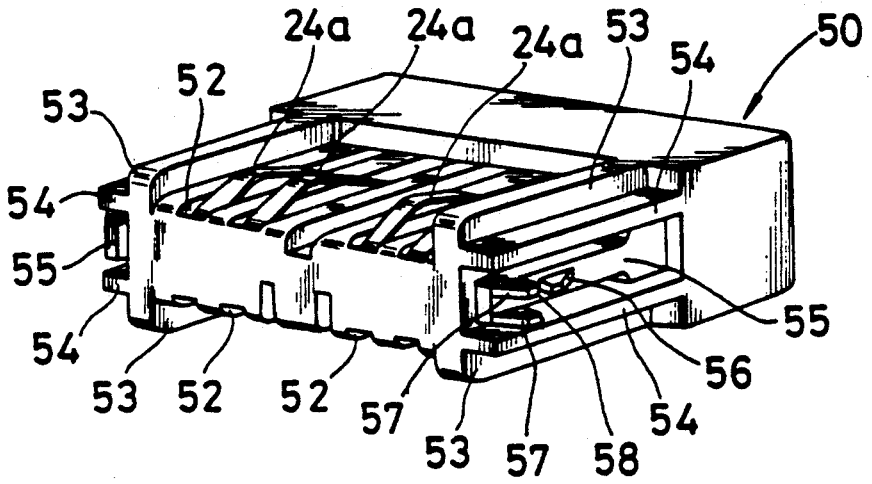
FIG. 15 is a perspective view of the electric connector according to the second embodiment of the invention, showing the electric connector without the protective cover.

The reference numeral 50 designates a male connector housing including a plural number of hollows 51 in two rows as shown in FIG. 12. In each hollow 51 is fixed a terminal 24 united with an electric wire 23 as shown in FIGS. 13 and 14. At the both sides of the housing 50 are formed a plural number of windows 52 through each of which a contact 24*a* of the terminal 24 juts out. The male connector housing 50 also includes fitting ridges 53 and 54 elongated in the direction of insertion of the housing 50. To the ridges 53 and 54 is slidablely fitted a protective cover 60 for protecting the terminals 24. As shown in FIGS. 11 and 15, at the sides of the male connector housing 50 are formed flexible locking arms 55 for locking the protective cover 60. The locking arms 55 each include a locking claw 56 formed nearly at the middle of the arm 55 and a pair of projections 57 at the end thereof. Consequently, a locking concave portion 58 is formed between the locking claw 55 and the pair of projections 57.

On the other hand, the protective cover 60 is made so ring-like as to surround the male connector housing 50. As shown in FIG. 11, the protective cover 60 includes locking convex portions 61 each of which is engaged with the locking concave portion 58. When the convex portion 61 of the protective cover 60 engages the concave portion 58 of the locking arm 55, each contact 24*a* of the terminals 24 is shielded by the protective cover 60. As shown in FIGS. 12 and 13, a plural number of ridges 62 are formed on the reverse side of the protective cover 60. The end surface of the ridge 62 is in contact with the sliding surface 59 of the housing 50 between the terminals 24, so that the terminals 24 are securely protected by the cover 60 without a bend of the protective cover 60 caused by external force. The locking projection 61 is slid on the sliding surface 59 in correspondence with the sliding of the protective cover 60.

In the second embodiment, when the male connector housing 50 is inserted into the female connector housing 31 the same as in the first embodiment, the projections 57 of the male connector housing 50 are pressed by the wall of the female connector housing 31, the locking arm 55 is bent, the locking convex portion 61 is disconnected from the locking concave portion 58, the convex portion 61 is separated from the tip of the locking claw 56, and the protective cover is slid.

Since the protective cover 60 is made ring-like and hence the guide frame 16 of the conventional electric connector is not required, the male connector housing 50 can be made smaller in size than the conventional one. Further, a single protective cover 60 can protect the terminals 24 disposed at the both sides of the housing 50 as shown in the second embodiment.

Figure 16:
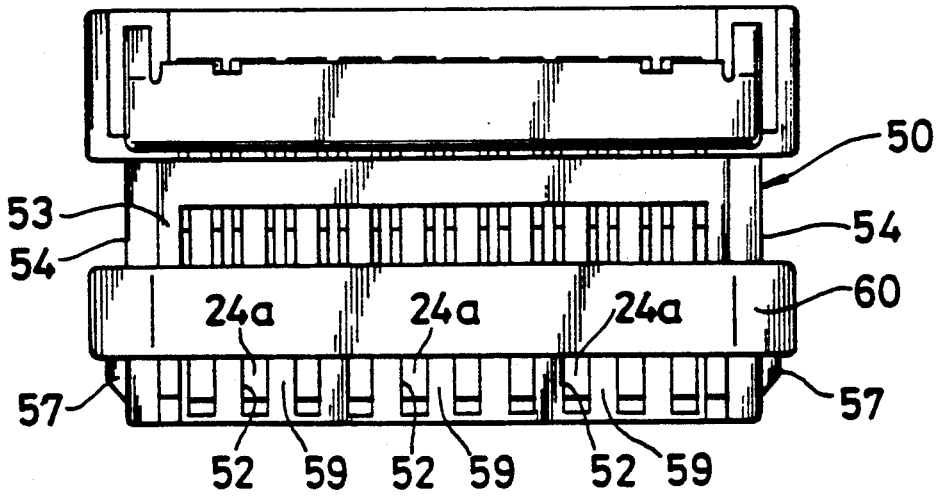
FIG. 16 is a front view of an electric connector according to a third embodiment of the invention.
Figure 17:
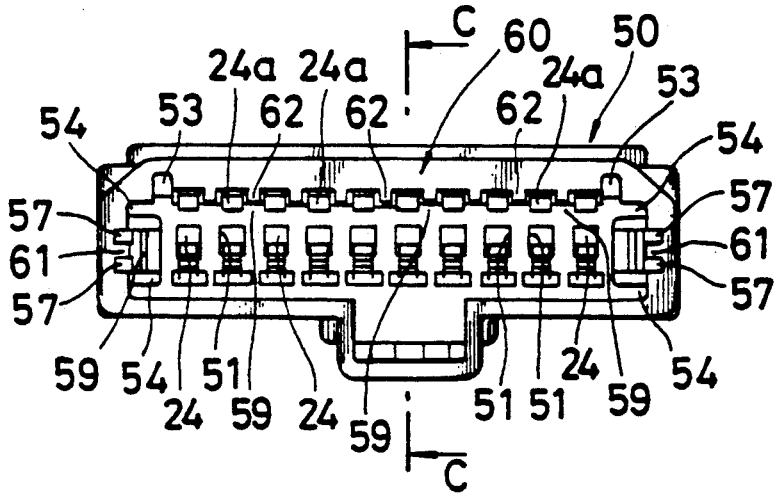
FIG. 17 is a bottom view of FIG. 16.
Figure 18:
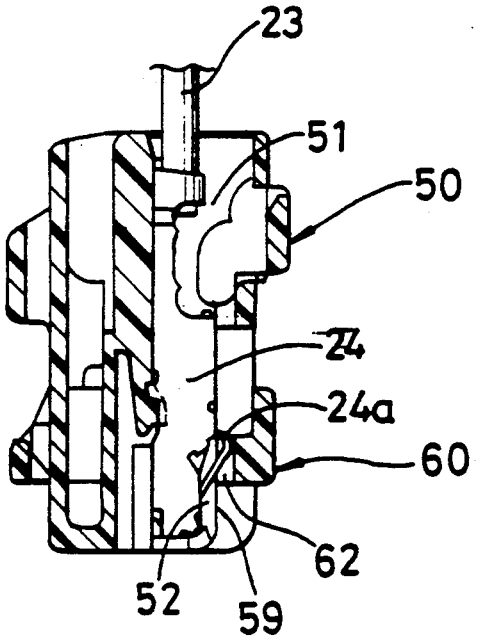
FIG. 18 is a sectional view taken along the line C—C of FIG. 17.

FIGS. 16 to 18 show a third embodiment of the invention.

An electric connector according to the third embodiment is characterized in that the terminals are disposed in one row in the male connector housing 50, contrary to the terminals in two rows shown in the second embodiment.

A description of the third embodiment will be omitted because of the same operation and construction to those of the second embodiment, except the construction of the terminals disposed in a row in the housing. In the third embodiment, the same numerals are each given to the same or equivalent components to those in the first and second embodiments.

What is claimed is:

1. An electric connector provided with a slidable protective cover capable of opening and closing a window through which terminals fixed in a connector housing are viewed, comprising:
   - a locking arm formed in said housing;
   - locking means for permitting said protective cover to keep said window closed, said locking means each formed at a place where said protective cover and said locking arm are engaged with each other;
   - means for bending said locking arm when said connector housing is inserted into a corresponding part; and
   - said protective cover being slid by bending said arm and releasing the interlock of said locking means with each other.

2. An electric connector provided with a slidable protective cover capable of opening and closing a window through which terminals fixed in a connector housing are viewed, comprising:
   - a locking arm formed in said housing;
   - said protective cover being made ring-like so as to surround said connector housing;
   - locking means for permitting said protective cover to keep said window closed, said locking means each formed at a place where said protective cover and said locking arm are engaged with each other;
   - means for bending said locking arm when said connector housing is inserted into a corresponding part; and
   - said protective cover being slid by bending said arm and releasing the interlock of said locking means with each other.

3. An electric connector provided with a slidable protective cover capable of opening and closing a window through which terminals fixed in a connector housing are viewed, wherein said protective cover is made ring-like so as to surround said connector housing.

4. An electric connector according to claim 1, wherein a plural number of ridges in contact with said connector housing between said terminals are formed on the reverse side of said protective cover.

5. An electric connector provided with a slidable protective cover capable of opening and closing a window through which terminals fixed in a connector housing are viewed, comprising an interior surface of said protective cover having a plural number of ridges formed so as to contact said connector housing between said terminals.

* * * * *